US008620196B2

(12) United States Patent
Wu et al.

(10) Patent No.: US 8,620,196 B2
(45) Date of Patent: Dec. 31, 2013

(54) TONER CARTRIDGE WITH A LOCK MECHANISM

(75) Inventors: Lianjun Wu, Guangdong (CN); Geming Ding, Guangdong (CN); Qingfei Peng, Guangdong (CN)

(73) Assignee: Zhuhai Seine Technology Limited, Zhuhai (CN)

( * ) Notice: Subject to any disclaimer, the term of this patent is extended or adjusted under 35 U.S.C. 154(b) by 29 days.

(21) Appl. No.: 13/131,877

(22) PCT Filed: Mar. 29, 2010

(86) PCT No.: PCT/CN2010/071379

§ 371 (c)(1),
(2), (4) Date: May 30, 2011

(87) PCT Pub. No.: WO2010/142162

PCT Pub. Date: Dec. 16, 2010

(65) Prior Publication Data

US 2012/0087699 A1 Apr. 12, 2012

(30) Foreign Application Priority Data

Jun. 12, 2009 (CN) ..... 2009 1 0107985

(51) Int. Cl.
*G03G 21/16* (2006.01)
*G03G 15/08* (2006.01)

(52) U.S. Cl.
USPC ..... 399/262; 399/120

(58) Field of Classification Search
USPC ..... 399/120, 262; 292/22, 160
See application file for complete search history.

(56) References Cited

U.S. PATENT DOCUMENTS

| | | | | | |
|---|---|---|---|---|---|
| 2,934,370 | A * | 4/1960 | Love et al. | ..... | 292/142 |
| 3,544,148 | A * | 12/1970 | Sandor | ..... | 292/336.3 |
| 5,046,340 | A * | 9/1991 | Weinerman et al. | ..... | 70/208 |
| 5,175,588 | A * | 12/1992 | Katagata | ..... | 399/106 |
| 7,062,205 | B2 * | 6/2006 | Nagashiro | ..... | 399/258 |
| 7,738,817 | B2 * | 6/2010 | Sasae et al. | ..... | 399/258 |
| 2007/0212118 | A1 * | 9/2007 | Nagae et al. | ..... | 399/260 |

FOREIGN PATENT DOCUMENTS

| | | | | | |
|---|---|---|---|---|---|
| JP | 2006003590 | A * | 1/2006 | ..... | G03G 21/16 |
| JP | 2007093697 | A * | 4/2007 | ..... | G03G 15/08 |
| JP | 2008116479 | A * | 5/2008 | ..... | G03G 21/16 |

* cited by examiner

*Primary Examiner* — Clayton E Laballe
*Assistant Examiner* — Leon W. Rhodes
(74) *Attorney, Agent, or Firm* — Jackson IPG PLLC

(57) ABSTRACT

The invention relates to a toner cartridge with a locking mechanism, including a body provided with a top cover and used for receiving a developer, wherein the locking and unlocking mechanism used for locking the toner cartridge into an image forming apparatus is arranged on the body. The locking mechanism includes a handle hinged with the top cover, a gear fixedly connected with the handle, a locking lever capable of reciprocating and a torsion spring used for realizing the automatic reset of the handle. A rack engaged with the gear is arranged on the locking lever. Moreover, the handle is driven to be close to the top cover under the action of a torque force of the torsion spring under the locking state, and the gear is engaged with the rack to drive the locking lever to be extended out of the top cover so as to lock the toner cartridge. When the handle is under the unlocking state by overcoming the torque force of the torsion spring under the action of an external force, the gear and the rack are operated to drive the locking lever to be retracted into the top cover so as to unlock the toner cartridge. Unlocking and locking can be realized through a tensile force of a human hand and the reset of the torsion spring.

3 Claims, 3 Drawing Sheets

TONER CARTRIDGE WITH A LOCK MECHANISM

FIELD OF THE INVENTION

The invention relates to a toner cartridge with a locking mechanism.

BACKGROUND OF THE INVENTION

With the popularity of image forming apparatuses among families, the use of small image forming apparatuses has become a trend, which results in that a developer will not take up much storage capacity and the service life of the image forming apparatuses will be longer than that of toner cartridges. Therefore, consumable toner cartridges are popular on the market and can be replaced once the developer is used out.

A locking mechanism is used in the prior art in order to guarantee the mounting and positioning of a toner cartridge and an image forming apparatus. Common locking mechanisms usually have the disadvantage of complex structure or inconvenient operation in order to realize the locking and unlocking of the toner cartridge on the image forming apparatus.

FIGS. 1 and 2 show a locking device of a toner cartridge in the prior art, after the toner cartridge is positioned into a toner cartridge mounting compartment of an image forming apparatus, the toner cartridge is clamped on a groove 10 of the image forming apparatus mainly in virtue of a lug 9 of a top cover 11 so as to realize the locking of the toner cartridge. With the structure, the lug 9 is fixed on the top cover 11 which is required to be capable of rotating relative to the toner cartridge in order to realize the unlocking and locking of the toner cartridge, so the structure is complex. Moreover, the top cover 11 can only be driven to rotate after a handle 8 of the top cover 11 is rotated by a human hand, so the operation is complicated.

SUMMARY OF THE INVENTION

The invention provides a toner cartridge with a locking mechanism to solve the technical problem of complicated operation of locking or unlocking of the prior toner cartridge with a locking mechanism.

In order to solve the said technical problem, the invention adopts the technical proposal that:

The invention provides a toner cartridge with a locking mechanism, which comprises a body provided with a top cover and used for receiving a developer, wherein a locking mechanism used for locking the toner cartridge into an image forming apparatus is arranged on the body; the locking mechanism comprises a handle hinged with the top cover, a gear fixedly connected with the handle and a locking lever capable of reciprocating; and a rack engaged with the gear is arranged on the locking lever.

The locking mechanism also comprises a torsion spring used for realizing the automatic reset of the locking lever.

The torsion spring is arranged on an articulated shaft for the handle, and two free ends of the torsion spring are butted with the handle and the top cover respectively.

Supporting structures for the locking lever are also arranged in the top cover and support the locking lever and limit the movement of the locking lever.

The handle is driven to be close to the top cover under the action of a torque force of the torsion spring under the locking state, and the gear is engaged with the rack to drive the locking lever to be extended out of the top cover so as to lock the toner cartridge; and when the handle is under the unlocking state by overcoming the torque force of the torsion spring under the action of an external force, the gear and the rack are operated to drive the locking lever to be retracted into the top cover so as to unlock the toner cartridge.

The periphery of the top cover corresponding to the extending position of the locking lever is provided with an opening.

By adoption of the technical proposal, the locking mechanism comprises the handle hinged with the top cover, the gear fixedly connected with the handle, the locking lever capable of reciprocating and the torsion spring used for realizing the automatic reset of the handle; the rack engaged with the gear is arranged on the locking lever; the handle is driven to be close to the top cover under the action of the torque force of the torsion spring under the locking state, and the gear is engaged with the rack to drive the locking lever to be extended out of the top cover so as to lock the toner cartridge; and when the handle is under the unlocking state by overcoming the torque force of the torsion spring under the action of the external force, the gear and the rack are operated to drive the locking lever to be retracted into the top cover so as to unlock the toner cartridge. The unlocking and locking can only be realized through a tensile force of a human hand and the reset of the torsion spring. Therefore, the operation is greatly simplified and the technical problem of complicated operation of locking or unlocking of the prior toner cartridge with a locking mechanism is solved.

DETAILED DESCRIPTION OF THE PREFERRED EMBODIMENTS

The drawings and embodiments are attached to provide deeper description of the invention.

Figure 1:
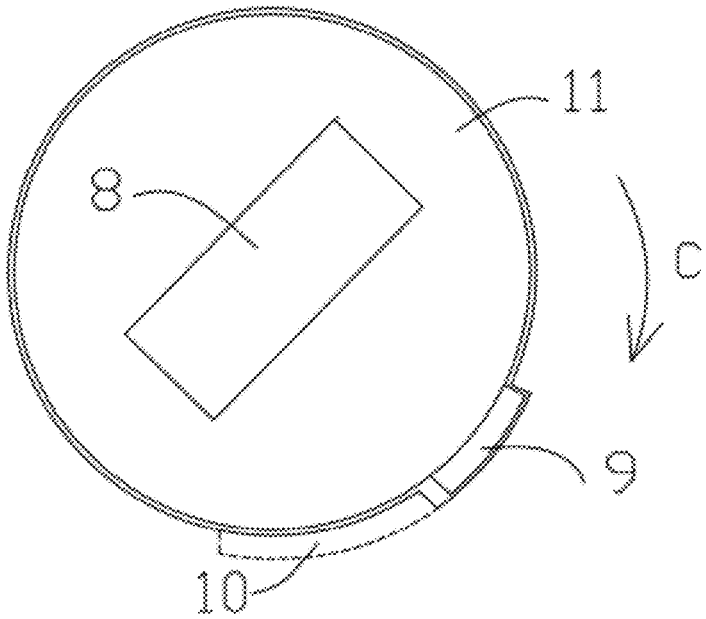
FIG. 1 (Prior Art)
FIG. 1 is an installation diagram of a toner cartridge in the prior art when a locking mechanism is unlocked.
Figure 2:
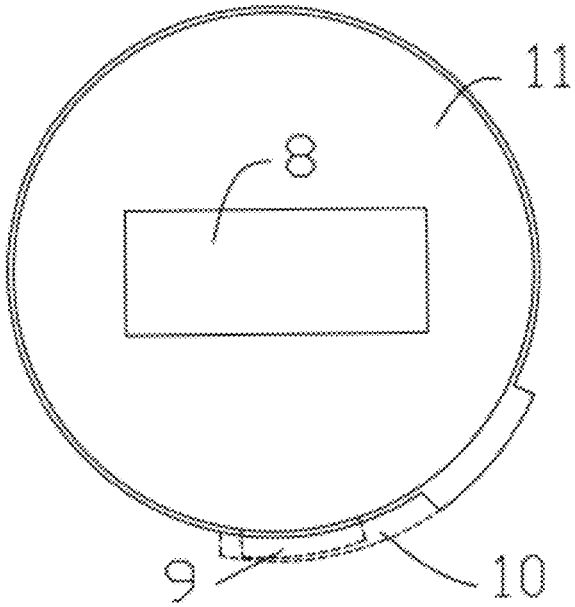
FIG. 2 (Prior Art)
FIG. 2 is an installation diagram of the said toner cartridge in the prior art when the locking mechanism is locked.
Figure 3:
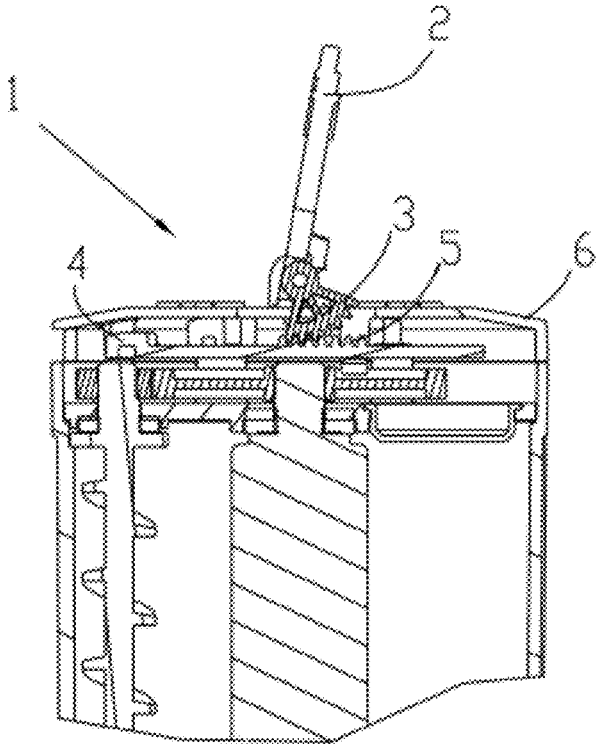
FIG. 3 is a partially sectional view of a toner cartridge of the invention when a locking lever is under the unlocking state.
Figure 4:
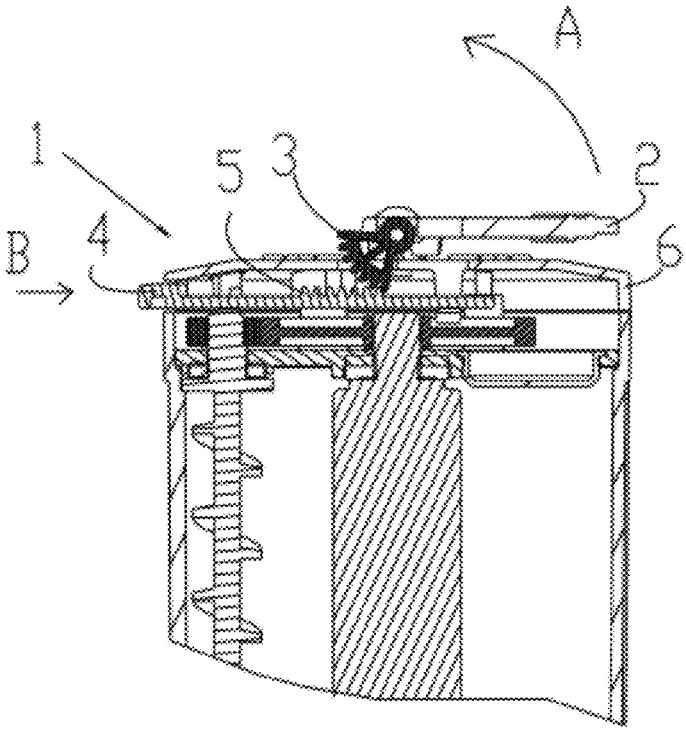
FIG. 4 is a partially sectional view of the said toner cartridge when the locking lever is under the locking state.

As seen in FIGS. 3 and 4, 1 represents a body of a toner cartridge, and a locking mechanism of the body comprises a handle 2, a gear 3 and a locking lever 4 provided with a rack 5. Moreover, a top cover 6 is arranged on the body of the toner cartridge.

Figure 5:
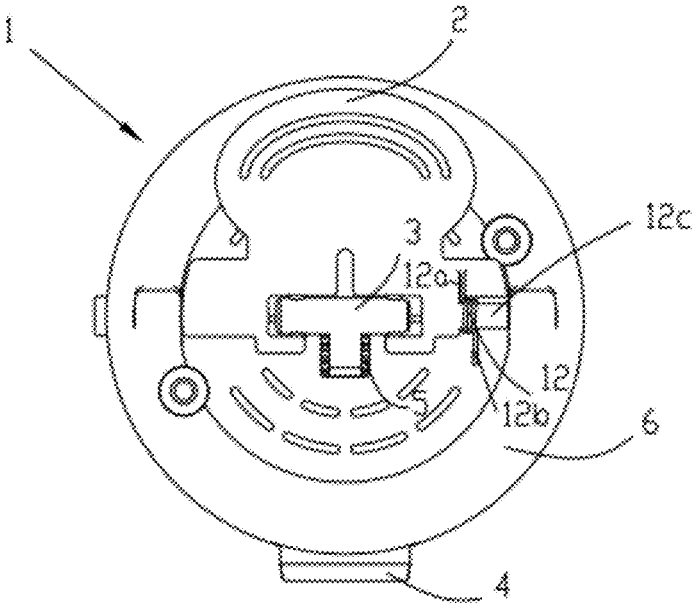
FIG. 5 is a structure diagram of a handle portion for the said toner cartridge.

As shown in FIG. 5, the gear 3 is fixedly connected to the handle 2 which is hinged with the top cover 6; a torsion spring 12 is arranged on an articulated shaft 12*c* of the handle 2; and two ends 12*a* and 12*b* of the torsion spring are butted with the handle 2 and the top cover 6 respectively so that the handle 2 is rotated to be close to the top cover 6 under the action of a restore torque force of the torsion spring 12 (as shown in the FIG. 4).

Figure 6:
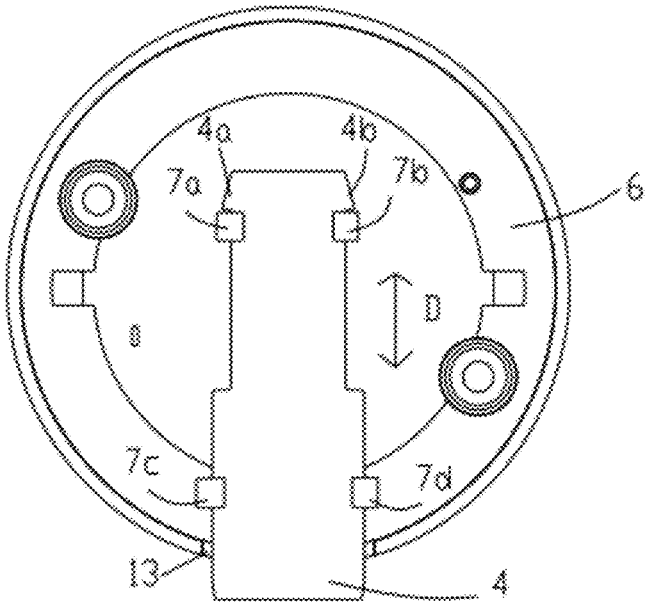
FIG. 6 is an assembly diagram of a locking lever portion for the said toner cartridge.

As shown in FIG. 6, the locking lever 4 is supported in the top cover 6 by supporting structures of the locking lever; the supporting structures for the locking lever in the embodiment consist of supports 7*a*, 7*b*, 7*c* and 7*d;* the top cover 6 is provided with an opening 13 in the circumferential direction; the opening 13 which corresponds to the extending position of the locking lever 4 reciprocate conveniently along the opening 13 in the directions as shown by an arrow D; limited posts of the locking lever 4*a* and 4*b* are also arranged on the locking lever 4; and the supports 7*a* and 7*b* contact the limited posts 4*a* and 4*b* to limit the movement of the locking lever 4.

As shown in FIG. 3, when the handle is under the unlocking state by overcoming a torque force of the torsion spring under the action of an external force, the handle 2 is rotated by the external force to a certain angle, and 80 to 90 degrees is a optimum angle range for the convenient operation of users; the gear 3 fixedly connected with the handle 2 rotates with the handle 2 simultaneously; and the gear 3 is engaged with the rack 5 to drive the locking lever 4 to be retracted into the top cover 6 of the toner cartridge 1, and the toner cartridge 1 is under the unlocking state at this time and can be packed into an image forming apparatus smoothly.

After the toner cartridge 1 is packed into the image forming apparatus, the handle is loosened and resets automatically under the action of the torsion spring 12 and is then restored to the state shown in the FIG. 4, and the restore process is also realized through the action of the gear and the rack; the locking lever 4 is extended out of the top cover 6 and positioned on the extending position, and the toner cartridge 1 is under the locking state at this time; the extending portion of the locking lever 4 is matched with a groove 10 in the image forming apparatus to realize the locking of the toner cartridge 1 in the image forming apparatus; and similarly, the toner cartridge 1 enters into the unlocking state after the handle is lifted and can be taken out from the image forming apparatus.

What is claimed is:

1. A toner cartridge with a locking mechanism, comprising a body provided with a top cover and used for receiving developer, said locking mechanism used for locking the toner cartridge into an image forming apparatus and arranged on said body, said locking mechanism comprising a handle hinged with said top cover, a gear fixedly connected with the handle and a locking lever capable of reciprocating;

and said locking lever comprising a rack engaged with said gear, wherein the locking mechanism also comprises a torsion spring used for realizing the automatic reset of the locking lever, wherein the torsion spring is arranged on an articulated shaft for the handle; and two free ends of the torsion spring are butted with the handle and the top cover respectively, wherein the handle is driven to be close to the top cover under the action of a torque force of the torsion spring under the locking state, and the gear is engaged with the rack to drive the locking lever to be extended out of the top cover so as to lock the toner cartridge; and when the handle is under the unlocking state by overcoming the torque force of the torsion spring under the action of an external force, the gear and the rack are operated to drive the locking lever to be retracted into the to cover so as to unlock the toner cartridge.

2. The toner cartridge with a locking mechanism according to claim 1, wherein supporting structures of the locking lever are also arranged in the top cover and support the locking lever and limit the movement of the locking lever.

3. The toner cartridge with a locking mechanism according to claim 1, wherein the periphery of the top cover corresponding to the extending position of the locking lever is provided with an opening.

* * * * *